US005289240A

United States Patent [19]

Wayman

[11] Patent Number: 5,289,240

[45] Date of Patent: Feb. 22, 1994

[54] SCAVENGELESS DEVELOPER UNIT WITH ELECTRODED DONOR ROLL

[75] Inventor: William H. Wayman, Ontario, N.Y.

[73] Assignee: Xerox Corporation, Stamford, Conn.

[21] Appl. No.: 63,817

[22] Filed: May 20, 1993

[51] Int. Cl.[5] ..... G03G 15/06

[52] U.S. Cl. ..... 355/259; 355/245; 355/261; 118/647; 118/651

[58] Field of Search ..... 355/245, 246, 259, 261, 355/262, 265, 247, 248, 249; 118/647-648, 651

[56] References Cited

U.S. PATENT DOCUMENTS 3,257,224 12/1962 Jons et al. ..... 117/17.5
4,282,303 8/1981 Bergen ..... 355/259 X
4,647,179 3/1987 Schmidlin ..... 355/262
4,994,859 2/1991 Mizuno et al. ..... 355/247
5,172,170 12/1992 Hays et al. ..... 355/259

*Primary Examiner*—Matthew S. Smith
*Attorney, Agent, or Firm*—R. Hutter

[57] ABSTRACT

An apparatus in which a donor roll advances toner to an electrostatic latent image recorded on a photoconductive member. A plurality of electrical conductors are located on the donor roll. The electrical conductors are spaced from one another and adapted to be electrically biased in the development zone to detach toner from the donor roll so as to form a toner cloud in the development zone. In the development zone, toner is attracted from the toner cloud to the latent image. A predetermined significant resistance at the interface between a commutator wiping brush and the electrodes limits arcing as the roll rotates.

5 Claims, 4 Drawing Sheets

SCAVENGELESS DEVELOPER UNIT WITH ELECTRODED DONOR ROLL

This application incorporates by reference U.S. Pat. No. 5,172,170, assigned to the assignee of this application. Cross-reference is also made to application Ser. No. 08/037,706, filed Mar. 25, 1993, entitled "Development System Coatings."

This invention relates generally to an electrophotographic printing machine, and more particularly concerns an improved scavengeless development system having a donor roll with electrode wires integral therewith.

Generally, the process of electrophotographic printing includes charging a photoconductive member to a substantially uniform potential so as to sensitize the photoconductive surface thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two-component and single-component developer materials are commonly used. A typical two-component developer material comprises magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to the development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development unit employs a magnetic brush developer roller for transporting carrier having toner particles adhering triboelectrically thereto. The donor roll and magnetic roll are electrically biased relative to one another. Toner is attracted to the donor roll from the magnetic roll. The electrically biased electrode wires detach the toner from the donor roll forming a toner powder cloud in the development zone. The latent image attracts the toner particles thereto from the toner powder cloud. In this way, the latent image recorded on the photoconductive member is developed with toner particles.

U.S. Pat. No. 3,257,224 discloses an apparatus for developing electrostatic images in which a developer roller transports both toner and a magnetic carrier. The roll is made up of rotor plates having windings to which current is supplied intermittently, and an outer cover of an insulating plastic material. The purpose of the electromagnetic windings within the roller is to attract developer material from a sump to the surface of the roller; the electromagnetism is cut off only to clean the roller and recycle the developer, after the given portion of the surface exits the development zone.

U.S. Pat. No. 5,172,170, assigned to the assignee of the present application, discloses a "scavengeless" development unit in which a set of longitudinally-disposed electrodes are mounted on a rotating donor roll. A wiping brush is used as a commutator to energize those electrodes in the development zone. When the electrodes are energized, the toner near the electrodes jumps off the donor roll and forms a powder cloud which may be used to develop the latent image. One practical problem which has been found with this system is that, at useful speeds and voltage levels, significant arcing occurs at the interface between the commutator brush and the electrodes which are repeatedly engaged and disengaged as the roll rotates. This arcing has the primary effect of damaging the donor roll, requiring replacement or repair thereof at impractically short intervals. It is one object of the present invention to provide such a "electroded donor roll" scavengeless development system in which this arcing and the effects thereof are reduced.

In accordance with one aspect of the present invention, there is provided an apparatus for developing a latent image recorded on a surface. A housing defines a chamber storing at least a supply of toner therein. The housing supports a moving donor roll spaced from the surface and adapted to transport toner from the chamber of the housing to a development zone adjacent the surface. A plurality of electrodes are longitudinally disposed on the donor roll. A commutator brush is provided to contact a subset of the electrodes along a portion of the circumference of the donor roll, thereby electrically biasing the subset of the electrodes to detach toner from the donor roll to form a cloud of toner in the development zone with toner developing the latent image. A predetermined resistance is provided at the interface of the commutator brush and the electrodes, such as by providing fibers on the commutator brush with predetermined resistivity, or by including a resistive coating on the donor roll.

Other features of the present invention will become apparent as the following description precedes and upon reference to the drawings, in which.

Inasmuch as the art of electrophotographic printing is well known, the various processing stations employed in the FIG. 3 printing machine will be shown hereinafter schematically and their operation described briefly with reference thereto.

Figure 5:
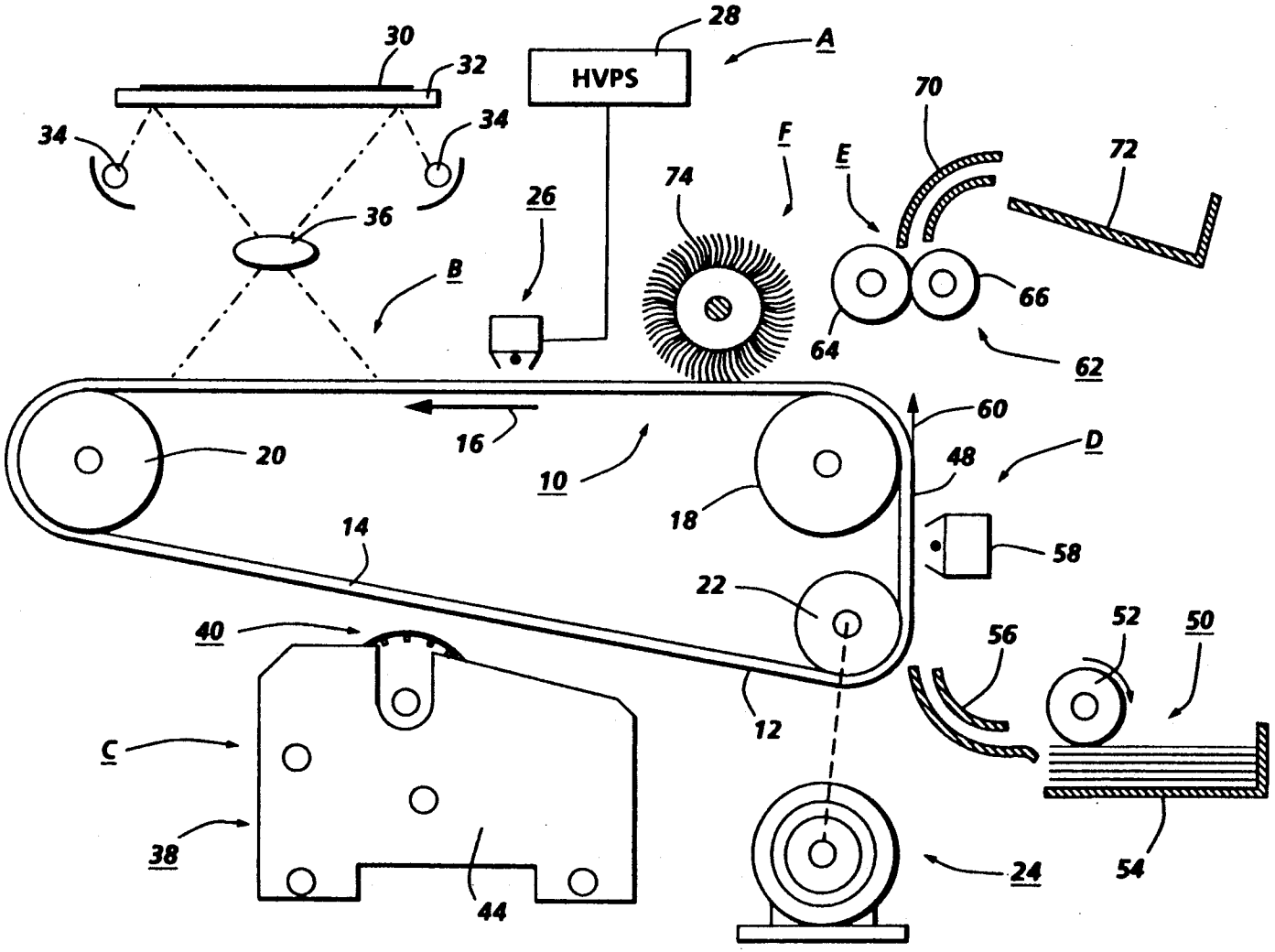
FIG. 5 is a schematic elevational view of an illustrative electrophotographic printing machine incorporating the FIG. 2 development apparatus therein.

Referring initially to FIG. 5, there is shown an illustrative electrophotographic printing machine incorporating the development apparatus of the present invention therein. The electrophotographic printing machine employs a belt 10 having a photoconductive surface 12 deposited on an electrically grounded conductive substrate 14. One skilled in the art will appreciate that any suitable photoconductive material may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Drive roller 22 is mounted rotatably in engagement with belt 10. Motor 24 rotates roller 22 to advance belt 10 in the direction of arrow 16. Roller 22 is coupled to motro 24 by suitable means, such as a drive belt. Belt 10 is maintained in tension by a suitable pair of springs (not shown) resiliently urging tensioning roller 20 against belt 10 with the desired spring force. Stripping finger 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30. Alternatively, a raster output scanner may be used in lieu of the light lens system previously described to layout an image in a series of horizontal scan lines with each line having a specified number of pixels per inch. Typically, a raster output scanner includes a laser with a rotating polygon mirror block and a modulator.

After the electrostatic latent image has been recorded on photoconductive surface 12, belt 10 advances the latent image to development station C. At development station C, a developer unit, indicated generally by the reference numeral 38 develops the latent image recorded on the photoconductive surface. Preferably, developer unit 38 includes a donor roller 40 having a plurality of electrodes or electrical conductors 42 embedded therein and integral therewith. The electrical conductors are substantially equally spaced and located closely adjacent to the circumferential surface of donor roll 40. Electrical conductors 42 are electrically biased in the development zone to detach toner from donor roll 40. In this way, a toner powder cloud is formed in the gap between donor roll 40 and photoconductive surface 12. The latent image recorded on photoconductive surface 12 attracts toner particles from the toner powder cloud forming a toner powder image thereon. Donor roller 40 is mounted, at least partially, in the chamber of developer housing 44. The chamber in developer housing 44 stores a supply of developer material. The developer material is a two-component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller at a loading zone. Developer unit 38 will be discussed hereinafter, in greater detail, with reference to FIG. 1.

With continued reference to FIG. 5, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 1:
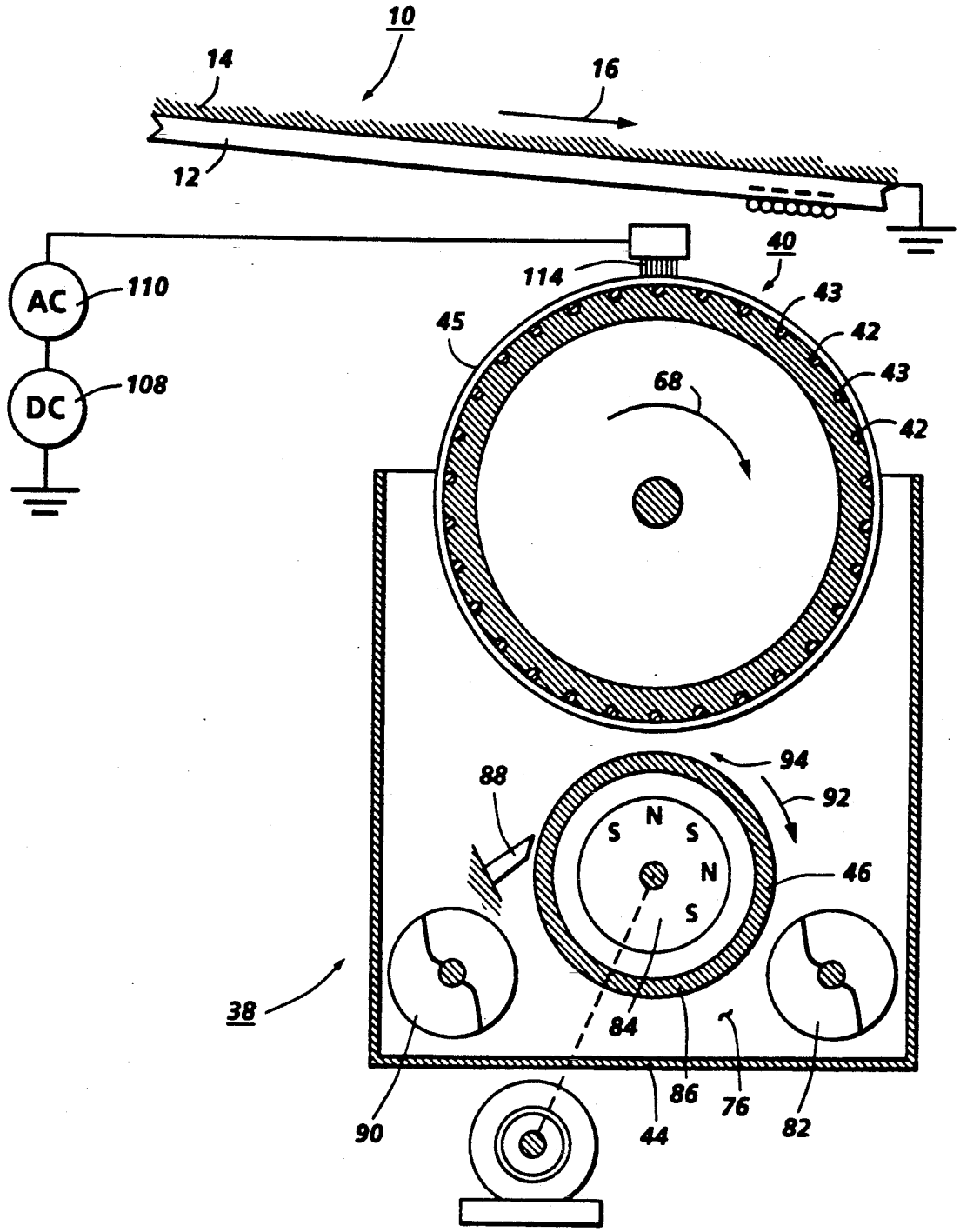
FIG. 1 is a schematic elevational view showing the development apparatus according to one embodiment of the invention.

Referring now to FIG. 1, there is shown developer unit 38 in greater detail. As shown thereat, developer unit 38 includes a housing 44 defining a chamber 76 for storing a supply of developer material therein. Donor roll 40 has electrical conductors 42 positioned in grooves about the peripheral circumferential surface thereof. The electrical conductors are substantially equally spaced from one another and insulated from the body of donor roll 40 which is electrically conductive. Donor roll 40 rotates in the direction of arrow 68. A magnetic roller 46 is also mounted in chamber 76 of developer housing 44. Magnetic roller 46 is shown rotating in the direction of arrow 92. Magnetic roller 46 and portions of donor roll 40 may be electrically biased relative to each other by AC and/or DC as required, by means not shown, in order to effect loading of toner from the magnetic roll 46 to the surface of the donor roll 40; one possible configuration of AC and DC biasing in such a unit is shown in U.S. Pat. No. 5,172,170, incorporated herein by reference. In the development zone, voltage sources 108 and 110 electrically bias electrical conductors 42 to a DC voltage having an AC voltage superimposed thereon. Voltage sources 108 and 110 are in wiping contact with isolated electrodes 42 in development zone by means of a brush 114, which will be described in detail below. As donor roll 40 rotates in the direction of arrow 68, successive electrodes 42 advance into the development zone 112 and are electrically biased by voltage sources 108 and 110. In this way, an AC voltage difference is applied between the isolated electrodes and the donor roll detaching toner from the donor roll and forming a toner powder cloud. Voltage 108 can be set at an optimum bias that will depend upon the toner charge, but usually the voltage is set at zero. The electroded donor roll assembly is biased by voltage sources 110 and 108.

Magnetic roller 46 advances a constant quantity of toner having a substantially constant charge onto donor roll 40. This ensures that donor roller 40 provides a constant amount of toner having a substantially constant charge in the development zone. Metering blade 88 is positioned closely adjacent to magnetic roller 46 to maintain the compressed pile height of the developer material on magnetic roller 46 at the desired level. Magnetic roller 46 includes a non-magnetic tubular member 86 made preferably from aluminum and having the exterior circumferential surface thereof roughened. An elongated magnet 84 is positioned interiorly of and spaced from the tubular member. The magnet is mounted stationarily. The tubular member rotates in the direction of arrow 92 to advance the developer material adhering thereto into a loading zone 94. In loading zone 94, toner particles are attracted from the carrier granules on the magnetic roller to the donor roller. Augers 82 and 90 are mounted rotatably in chamber 76 to mix and transport developer material. The augers have blades extending spirally outwardly from a shaft. The blades are designed to advance the developer material in a direction substantially parallel to the longitudinal axis of the shaft.

Looking at wiping brush 114 in greater detail, it can be seen that the brush 114 includes a plurality of filaments which contact a section of the circumference of a donor roll 40, so that the electrode wires 42 in development zone adjacent the surface 12 of belt 10 may be energized as desired by the AC source 110 and DC source 108. The brush thus acts to energize only those electrodes 42 in the development zone. This AC and DC biasing of the electrodes 42 cause toner loaded on the surface of donor roll 42 to jump off the surface of the donor roll 40 and form a powder cloud so that some of the toner in the powder cloud will adhere to the surface 12 of belt 10, thereby developing the electrostatic latent image thereon.

Figure 2:
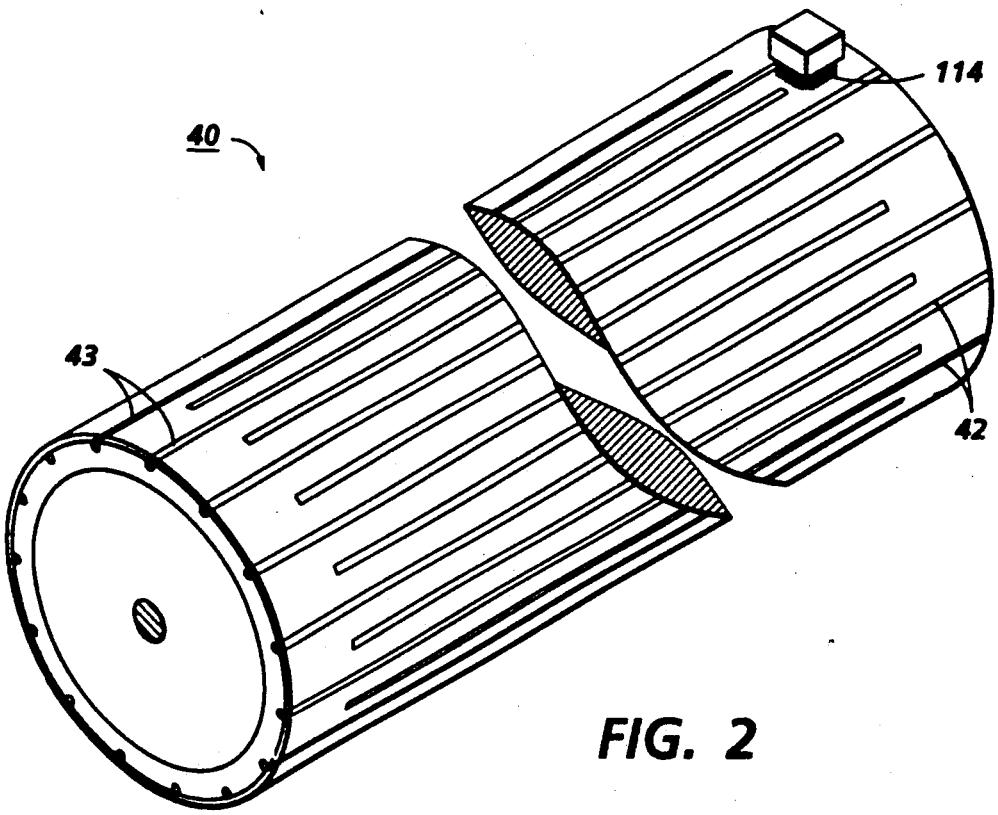
FIG. 2 is a perspective view of a segmented electroded donor roll and commutator brush, according to one embodiment of the invention, in isolation.

Turning to FIG. 2, which shows donor roll 40 and brush 114 in isolation, can be seen that the brush 114 is disposed at one end of the donor roll 40, preferably at a location spaced away from the length of the donor roll 40 corresponding to the imaging area on belt 10. It will be seen in FIG. 2 that the filaments of brush 114 contact electrodes 42 at one end of the donor roll 40; of course, contact by the filaments at this one point will energize the contacted electrodes 42 for the entire length thereof.

In the embodiment of the present invention shown in FIG. 2, there are also provided a set of passive electrodes shown as 43, which are interdigitated with the electrodes 42. Like the electrodes 42, the passive electrodes 43 are disposed longitudinally along the donor roll 40, but, as can be seen in FIG. 2, do not extend to the end of donor roll 40 where they may be contacted by the filaments of brush 114. Instead of being contacted by brush 114, the passive electrodes 43 are connected to a bias source. One possible way of biasing the passive electrodes 43 is to provide some means (not shown) on the donor roll 40 of connected the passive electrodes 43 to the axle thereof.

The purpose of the passive electrodes 43 interdigitated with electrodes 42 is to, in effect, create a series of abutting capacitors along the circumference of donor roll 40. The alternating electrodes 42 and passive electrodes 43 form a series of back-to-back capacitor plates with spacing therebetween. The electric field associated with these capacitors can thus be used to cause toner particles on the surface of donor roll 40 in the development zone to form the desired powder cloud as the electrodes 42 are energized.

One practical problem that has been observed with an electroded donor roll of the design shown in FIG. 2 is the undesirable arcing at the "lead" and "trail" edges of the brush 114 as successive electrodes 42 are caused to connect and disconnect with the brush 114 as the donor roll 40 rotates. A typical bias voltage of the AC being transferred from the brush 114 to the electrodes 42 is 1,400 volts at peak (i.e., 2,800 V peak to peak). Even though the current may be quite low, the high potential creates arcing and its allied problems of forming sparks, heat, and other phenomena with the main detrimental effect of damaging the electrodes 42 and thereby causing an expensive repair problem.

To minimize the destructive arcing between the wiping brush 114 and the electrodes 42, it is desirable to incorporate a significant resistance at the interface of the brush 114 and the electrodes 42. The combination of this resistance with the series of capacitors along the circumference of the donor roll 40 in effect creates a set of RC circuits, although merely providing an added resistance in the wiring to the wiping brush 114 will not work: it has been found to be crucial to provide this resistance at the interface of the brush and the electrodes, which is where the arcing occurs. One way of providing this desirable significant resistance is to provide a predetermined resistance to the filaments of brush 114 itself. It has been found that, for a donor roll in which each electrode 42 or 43 is approximately 0.1 mm in width along the donor 40 and with an applied voltage of up to 1,400 volts AC, the filaments of the brush together should have an effective electrode contact resistance of 1–100 KΩ, although the resistance could conceivably be as high as 1 MΩ. One material that has been shown to be practical for the purpose of providing this desired resistance combined with other desirable properties is a brush made from 7 micron carbon fibers, which are commercially available and which have a resistance per fiber on the order of $5\times10^9$ Ω per cm of length.

Figure 3A:
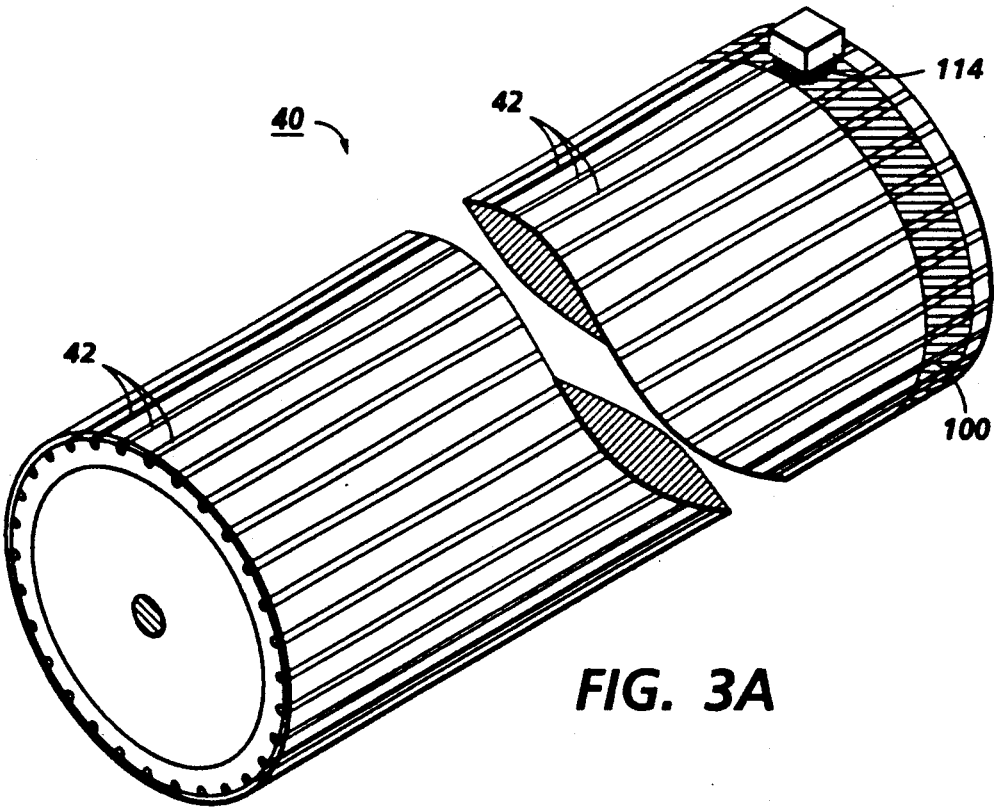
FIG. 3A is a perspective view of a segmented electroded donor roll and commutator brush, according to another embodiment of the invention, in isolation.
Figure 3B:
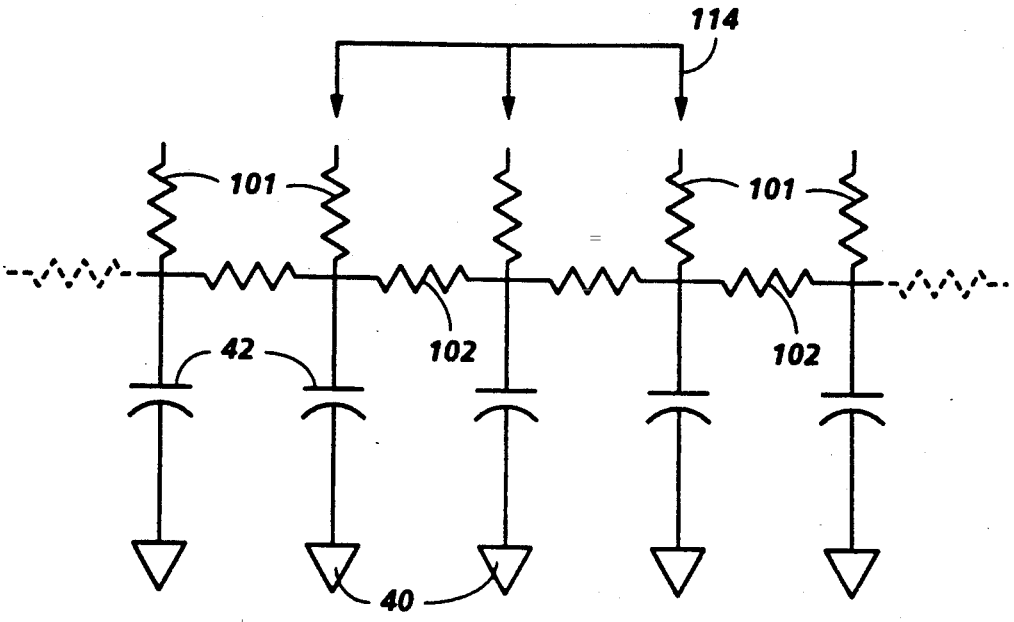
FIG. 3B is a schematic representation of the interface between the commutator brush and the donor roll.

FIG. 3A shows an adaptation of the concept of the present invention to an electroded donor roll of a simpler design, that is, in which all of the electrodes on the surface of the donor roll 40 are connectable to the brush 114; i.e., in the embodiment of FIG. 3A, there are no interdigitated passive electrodes, as in the embodiment of FIG. 2. FIG. 3B is a schematic diagram illustrating the circuit elements created by the electroded donor roll 40 and brush 14. In such an embodiment of an electroded donor roll, there is provided between the electrodes 42 and a conductive core of donor roll 40 a dielectric (not shown) causing all of the electrodes 42 disposed on the surface of donor roll 40 to form a set of capacitors in regard to the core. The surface of the core thus becomes a common capacitor plate for all of the electrodes 42 around the donor roll, although of course only the electrodes 42 being contacted by the brush 114 at a given moment will be energized and in fact functioning to create a toner cloud.

In this embodiment of the present invention, the desired resistance for preventing arcing may be provided not only by providing filaments of predetermined resistivity in the brush 114, but also by laminating the portion of the donor roll 40 in contact with the brush 114 with a thin resistive coating, so that an added resistance is in the interface between the brush and a given electrode. In FIG. 3A, the resistive coating is shown as a band 100 which corresponds to the path of the brush 114. When such a resistive coating is used, there will not only be a relatively high resistance between the brush 114 and a given electrode 42, but, equally significantly, there will also be provided a resistance between an electrode 42 in contact with the brush 114 at a given moment and an adjacent electrode 42 not yet in contact with the brush. Turning to the schematic diagram of of FIG. 3B, the band 100 effectively creates a resistance 101 between the commutator brush 114 and each electrode 42 forming a capacitor with the core of donor roll 40, and also creates a series of resistances 102 between each electrode 42. It is preferred that the resistance provided by the band 100 between the brush 114 and an electrode 42 be in the range of 1-100 KΩ, although the resistance could conceivably be as high as 1 MΩ.

In one example, if the resistive coating is 25 microns thick and 5 mm wide, assuming 0.1 mm wide electrodes and 0.2 mm spaces between electrodes, an adjacent electrode not directly under the the brush will, because of the continuous nature of the resistive coating, have 8 times the series resistance to the AC bias supply, as compared to the electrode directly under the brush, because of the aspect ratios of the resistive coating. In terms of the schematic of FIG. 3B, each resistance 102 will be eight times that of each resistance 101. Thus, there will not only be a desirable distributed resistance between the brush and the electrodes, but also a resistance between adjacent electrodes, thereby providing a gradual increase (or decrease) in voltage applied to the electrodes as they approach (or leave) the brush contact region, and thus preventing or decreasing arcing at the brush to roll interface as the donor roll 40 rotates. When such a resistive coating is used, moreover, the brush 114 itself is not necessarily resistive. Thus, a conductive brush may be used in conjunction with the resistive coating.

In the preferred embodiments of the present invention, the outer coating of the donor roll 40, shown as 45, should be of a substance which has some predetermined electrical resistance associated therewith, but which is also transparent to electric fields; this combination of properties has been shown to be effective in obtaining the desired behavior of toner particles when electrodes beneath the coating 44 are energized. One coating composition which has been found to be useful for this purpose is disclosed in a co-pending application Ser. No. 08/063,817, filed Mar. 25, 1993, entitled "Development System Coatings." This application discloses a coated transport means comprised of a core with a coating comprised of charge transporting molecules and an oxidizing agent, or oxidizing agents dispersed in a binder. For obtaining the desired high resistance of band 100 in the embodiment of FIG. 3, the composition of the band may be modified, such as by increasing the amount of conductive material in the coating.

The key to the function of the added resistance to the commutator is that an added resistance will tend to increase the difference between the voltage applied to the brush and the voltage formed on each electrode 42. Generally, if the series resistance between the brush and the electrodes 42 is construed as a series resistance R and the effective capacitor created either by two adjacent electrodes 42 and 43 (in FIG. 2) or by the electrode 42 and the common biased portion of the donor roll 40 (in FIG. 3) is construed as capacitance C, the ratio of the electrode voltage to the brush voltage for a given AC frequency ω will be given by the familiar RC filter equation $$V_{electrode}/V_{brush}=1/(1+\omega^2R^2C^2)^{\frac{1}{2}}$$

With a lower resistance R, there will thus be less of a voltage difference between an electrode 42 in contact with the brush 114 at a given moment and an adjacent electrode 43 which is not in contact with the brush at that moment. This lessening of the voltage difference between adjacent electrodes will decrease the likelihood of arcing. However, there is a limit to lowering resistance too far, because, for example, too low a resistance through the band 100 in the FIG. 3A embodiment will cause a short among the electrodes 42 around the roll, and thus defeat the desired commutation function. Another incidental advantage of substantially resistive fibers is that, should any fibers break off the wiping brush 114 in use, these loose fibers, being relatively highly resistive, are less likely to short out other electrical components in the vicinity of the developer unit.

Figure 4:
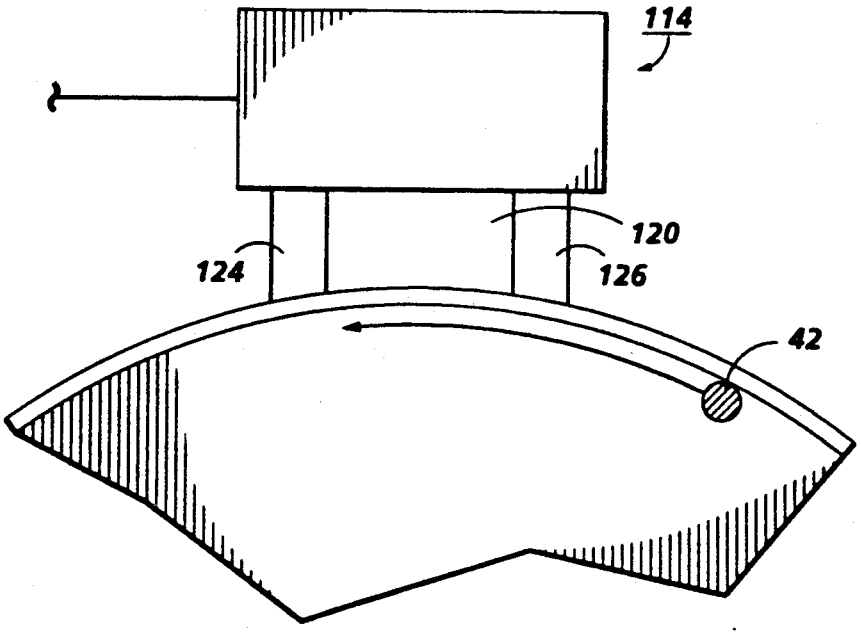
FIG. 4 is an elevational view of a wiping brush according to another embodiment of the invention.

FIG. 4 shows an alternate embodiment of a brush 114, which may be used with the embodiment of FIG. 2, or the embodiment of FIG. 3 as well. This modified brush 114 may include a central portion of filaments 120, bounded on each side along the circumference of donor roll 40 by sections of boundary filaments 124 and 126. The filaments in the boundary portions 124, 126 are of a higher resistivity than the filaments in the central portion 120. The advantage of this brush is that it provides a gradual increase of voltage to an electrode 42 passing under the brush, i.e. the high resistance portion 126 will allow the bias on a moving electrode 42 to taper up to a high voltage experienced in the central section 120, and then again taper down to a zero voltage as the electrode 42 leaves the development zone through section 124. This relatively gradual change in voltage on a given electrode is useful in reducing arcing along the lead and trail edges of a brush 114.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface, including:

a housing defining a chamber storing at least a supply of toner therein;

a moving donor roll spaced from the surface and adapted to transport toner from the chamber of the housing to a development zone adjacent the surface;

a plurality of electrodes longitudinally disposed on the donor roll; and a commutator contacting the electrodes along a portion of the circumference of the donor roll adjacent the development zone, the commutator including a brush having fibers in contact with portions of a subset of the electrodes, the brush having a predetermined contact resistance between about 1KΩ and 1MΩ.

2. An apparatus as in claim 1, further comprising a second plurality of electrodes interdigitated on the donor roll with the first-mentioned plurality of electrodes, the second plurality of electrodes being adapted not to contact the brush.

3. An apparatus as in claim 1, wherein the brush includes a first portion having fibers of a first predetermined resistance and a second portion having fibers of a second predetermined resistance.

4. An apparatus as in claim 3, wherein the brush includes, along a portion of the circumference of the donor roll, a first portion having fibers of a first predetermined resistance, a second portion having fibers of a second predetermined resistance, and a third portion having fibers of a third predetermined resistance, the second predetermined resistance being less than the first and third predetermined resistances.

5. An apparatus for developing a latent image recorded on a surface, including:

a housing defining a chamber storing at least a supply of toner therein;

a moving donor roll spaced from the surface and adapted to transport toner from the chamber of the housing to a development zone adjacent the surface;

a plurality of electrodes longitudinally disposed on the donor roll;

a commutator adapted to contact electrodes along a portion of the circumference of the donor roll, the commutator including a brush having fibers adapted to contact portions of a subset of the electrodes; and a coating disposed on the surface of the donor roll and providing predetermined resistance between the brush and the electrodes of between about 1KΩ and 1MΩ.

* * * * *